United States Patent [19]

Bodig et al.

[11] 4,271,812

[45] Jun. 9, 1981

[54] APPARATUS FOR MAINTAINING CONSTANT IGNITION ENERGY WITH INCREASING ENGINE SPEEDS IN AN IGNITION SYSTEM FOR AN INTERNAL COMBUSTION ENGINE

[75] Inventors: Bernd Bodig, Leinfelden; Helmut Schmied, Remshalden; Gerd Höhne, Ludwigsburg; Adolf Fritz, Stuttgart, all of Fed. Rep. of Germany

[73] Assignee: Robert Bosch GmbH, Stuttgart, Fed. Rep. of Germany

[21] Appl. No.: 60,772

[22] Filed: Jul. 26, 1979

[30] Foreign Application Priority Data

Jul. 29, 1978 [DE] Fed. Rep. of Germany ..... 2833343

[51] Int. Cl.[3] ..... F02P 3/04

[52] U.S. Cl. ..... 123/609; 123/618; 123/644

[58] Field of Search ..... 123/148 E; 315/209 T

[56] References Cited

U.S. PATENT DOCUMENTS

| | | | |
|---|---|---|---|
| Re. 29,862 | 12/1978 | Roozenbeek et al. | 123/148 E |
| 3,605,713 | 9/1971 | LeMasters et al. | 315/209 T |
| 3,838,672 | 10/1974 | Richards et al. | 123/148 E |
| 4,167,927 | 9/1979 | Mikami et al. | 123/148 E |
| 4,202,304 | 5/1980 | Jundt et al. | 123/148 E |

*Primary Examiner*—Charles J. Myhre
*Assistant Examiner*—Andrew M. Dolinar
*Attorney, Agent, or Firm*—Frishauf, Holtz, Goodman & Woodward

[57] ABSTRACT

In order to increase the closure angle of an interrupter switch connected in series with the primary winding of an ignition coil with increasing engine speeds, a capacitor is connected to the input of a trigger circuit whose output controls this closure angle. The capacitor is charged through a diode while the trigger circuit is switched out. The voltage across the capacitor shifts the threshold of the trigger circuit in a direction increasing the time that the interrupter switch is conductive. The charge on the capacitor is controlled by a signal generator which furnishes an output signal having an amplitude increasing with increasing engine speeds. The closure angle of the interrupter switch therefore also varies as a function of engine speed.

7 Claims, 5 Drawing Figures

APPARATUS FOR MAINTAINING CONSTANT IGNITION ENERGY WITH INCREASING ENGINE SPEEDS IN AN IGNITION SYSTEM FOR AN INTERNAL COMBUSTION ENGINE

The present invention relates to ignition systems in internal combustion engines. In particular, it relates to systems wherein a signal generator furnishes a voltage whose amplitude increases with increasing engine speed and wherein a trigger circuit is controlled by this signal and in turn controls the closure angle of an interrupter switch connected in series with the primary winding of the ignition coil.

BACKGROUND AND PRIOR ART

An ignition system of the above-described type is described in U.S. Pat. No. 3,881,458, assigned to the assignee of this application, to which U.S. Pat. No. Re. 29,862, and German DE-OS No. 22 44 781 corresponds. In the known ignition system a Schmitt trigger circuit is connected on the input side with the output of an inductive signal generator. The output voltage of the inductive signal generator increases with increasing speeds. The output of the trigger circuit in the known apparatus is connected to the input of a control stage which includes a transistor and a storage element. The output of the control stage in turn controls a driver stage whose output controls the output stage of the ignition system, namely an electronic switch constituted by a Darlington transistor circuit which is connected in series with the primary winding of the ignition coil. In this system, the energy stored in the storage decreases with increasing engine speed so that the ratio of conductive to blocked time of the interrupter switch increases with increasing engine speed. However, the increase in the conductive time of the interrupter switch or the increase in the closure angle relative to that determined on the basis of the on/off time of the trigger circuit is very limited and the circuitry of the control stage requires a substantial amount of additional components and is therefore relatively expensive.

THE INVENTION

It is an object of the present invention to furnish a closure angle control circuit which does not require much additional equipment but will still allow a very substantial increase with increasing speed of the relative closure angle of the interrupter switch relative to that which would be determined by the amplitude of the signal furnished by the signal generator and the threshold of the trigger circuit. In particular, it is desired that the conduction time of the interrupter switch be adjustable between the time based on the above-mentioned basic circuit characteristics and a value of 100 percent.

It is a further object of the present invention that the closure angle varies as a function of battery voltage in such a way that it increases with decreasing battery voltages and vice versa.

It is a further object of the present invention to provide an ignition system having the above-described characteristics wherein it is also possible to include circuitry for limiting the primary current and for blocking any flow of quiescent current.

In accordance with the present invention, a storage means, e.g. a capacitor is connected to the input of the trigger circuit. The capacitor is charged through at least one unidirectional conducting element, e.g. a diode while the trigger circuit is switched out and the amount of charge varies as a function of the amplitude of the speed-dependent signal. The charge on the storage shifts the threshold values of the trigger circuit in a direction increasing the closure time of the interrupter switch.

DRAWINGS ILLUSTRATING A PREFERRED EMBODIMENT

Figure 1:
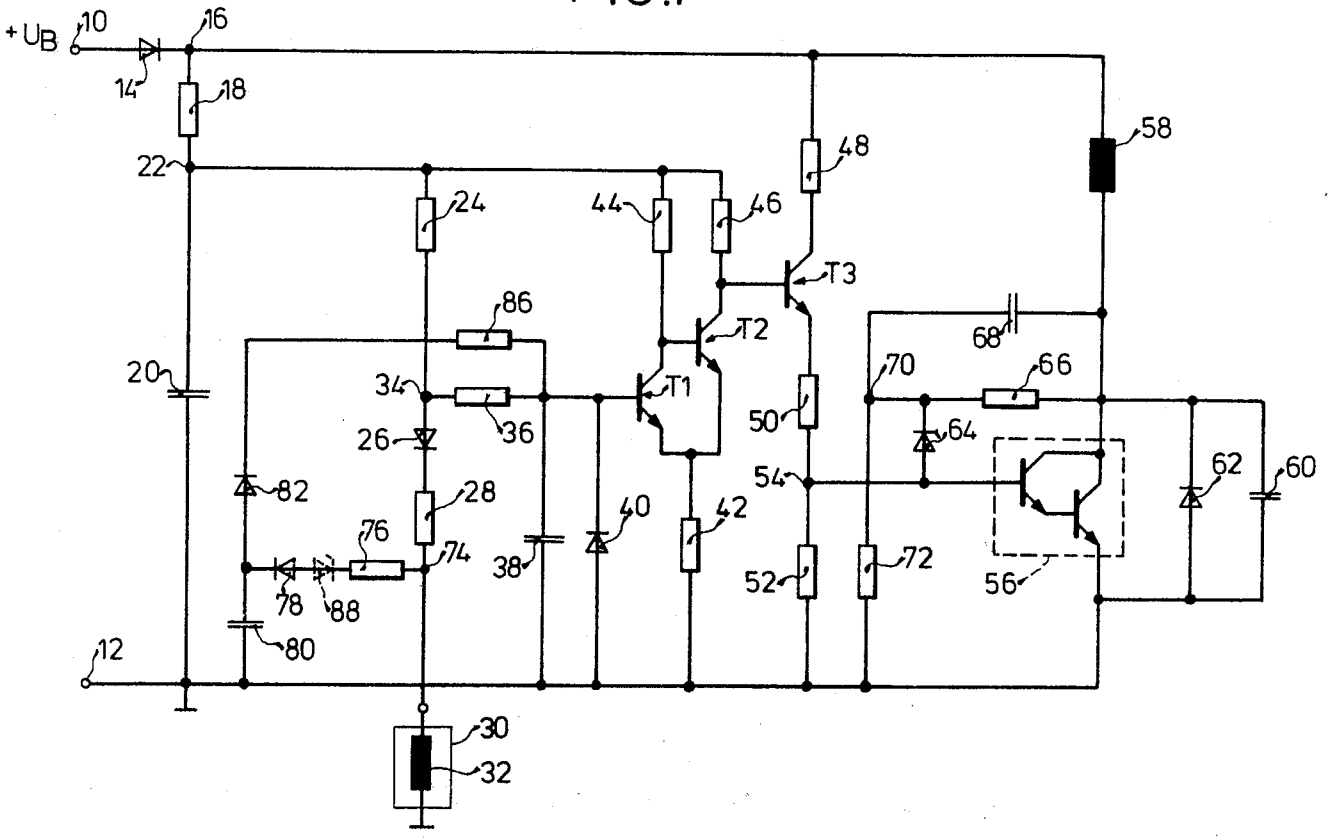
FIG. 1 is a circuit diagram of a preferred particularly simple form of an ignition system of the present invention.

Referring now to FIG. 1, a first input terminal 10 is connected to the positive terminal of a battery while a second input terminal 12 is connected to the negative terminal of the battery and to a reference potential as, for example, ground potential. The potential difference between the terminal 10 and terminal 12 is thus the battery voltage UB. A diode 14 has an anode connected to terminal 10 and a cathode connected to a terminal 16, the latter being connected to reference potential through a resistor 18 and a capacitor 20. The common point of resistor 18 and capacitor 20 is designated by reference numeral 22. Terminal 22 is connected through a series circuit including a resistor 24, a diode 26 and a resistor 28 to a signal generator 30. More specifically, it is connected to one terminal of the output winding 32 of signal generator 30, the other end of the winding being connected to reference potential. The common point 34 of resistor 24 and diode 26 is connected through a resistor 36 to the base of a transistor T1. The base of transistor T1 is further connected to reference potential through a parallel circuit including a capacitor 38 and a diode 40. The cathode of diode 40 is connected to the base of transistor T1. The emitter of transistor T1 is directly connected to the emitter of a transistor T2 and is further connected to reference potential through a resistor 42. The collector of transistor T1 is connected to the base of transistor T2 and, through a resistor 44, to circuit point 22. The collector of transistor T2 is connected to the base of a transistor T3 and, through a resistor 46, to circuit point 22. The collector of transistor T3 is connected to circuit point 16 through a resistor 48, while its emitter is connected to reference potential via a series circuit including two resistors 50, 52. The common point 54 of resistors 50, 52 is connected to the base of the input transistor of a Darlington circuit 56 which constitutes the electronic interrupter switch for the ignition current. The emitter of Darlington transistor circuit 56 is directly connected to reference potential, while its collector is connected to one end of a primary winding 58 of the ignition coil, the other end of the primary winding being connected to circuit point 16, that is to the positive supply. The parallel circuit of a capacitor 60 and a diode 62 is connected in parallel to the switching circuit of interrupter switch 56. Specifically, the anode of diode 62 is connected to the emitter of the output transistor of the Darlington circuit, while its cathode is connected to the collector. A series circuit including a Zener diode 64 is connected in parallel with the collector-base circuit of interrupter switch 56, a capacitor 68 being connected in parallel with resistor 66. The common point, 70, of capacitor 68 and resistor 66 is connected through a resistor 72 to reference potential.

With the exception of resistor 36, the above-described circuit elements constitute the conventional ignition system in which the conductive time and the blocked time of interrupter switch 56 is determined by the on/-off ratio which results from the configuration of signal generator 30 and that of the Schmitt trigger including transistors T1 and T2. According to the present invention, the common point 74 of resistor 28 and output winding 32 of signal generator 11 is connected to a series circuit including a resistor 76 and a diode 78 whose anode is connected to resistor 76 while its cathode is connected to a capacitor 80 whose other terminal is connected to reference potential. The cathode of diode 78 is further connected through a diode 82 to a resistor 86 whose other terminal is connected to the base of transistor T1. Additionally, but not necessarily, an additional Zener diode 88 may be connected between the anode of diode 78 and resistor 76, the Zener diode being connected with a polarity opposite to that of diode 78. In FIG. 1, Zener diode 88 is indicated by broken lines, since it is not an essential element.

OPERATION

Diode 14 prevents the application of reverse voltages to the circuit. Resistor 18 and capacitor 20 cause the voltage at circuit point 22 to be free of spikes which might interfere with the operation of the Schmitt trigger including transistors T1 and T2. Circuit components 24, 26, 28, 36, 38 and 40 constitute an input circuit for the Schmitt trigger which includes transistors T1 and T2 as well as resistors 42–46. The input circuit is so designed that the desired thresholds for the Schmitt trigger result for a predetermined signal generator 30. Transistor T3 with its associated resistors 48–52 constitute a driver stage for the Darlington transistor circuit 56 which constitutes the output stage, that is the electronic interrupter switch. The latter is equipped with a collector-base clamping circuit with circuit components 64–72 for protection against overvoltages. Overvoltage protection is also provided by diode 62 and capacitor 60 connected in parallel with the emitter-collector circuit of the interrupter switch.

The above-described circuit is augmented by capacitor 80 which is ineffective during low rotational speeds of the engine with which the ignition system is associated, that is for low frequencies of signal generator 30. However, at higher engine speeds, capacitor 80 is charged during the positive half waves appearing across winding 32 through diode 78 and resistor 76. When the voltage across capacitor 80 becomes sufficient to allow conduction through diode 82, the voltage is applied to the base of transistor T1 and changes the switch-in threshold of the Schmitt trigger. With increasing speeds, the amplitude of the output voltage of signal generator 30 increases thereby increasing the voltage across capacitor 80. This increase of voltage across capacitor 80 causes a steadily increasing shifting of the switch-in threshold of the Schmitt trigger and a shifting of the switch-out level towards increasingly negative values of the voltage furnished by signal generator 30 so that the closure angle of the interrupter switch increases steadily over the normal on/off ratio. It is actually possible with the circuit in FIG. 1 to achieve a relative closure angle of up to 100 percent. Resistor 36 plays an important role in allowing the increase in closure angle, since it prevents a rapid discharge of capacitor 80 through diode 26, resistor 28 and winding 32. This in turn allows resistors of relatively high resistance values to be used for resistors 76 and 86, so that their presence in itself results in a relatively small threshold shift. Further, the presence of resistor 36 allows a particularly good variation of closure angle as a function of battery voltage. Specifically, when the battery voltage $U_b$ decreases, the closure angle is increased and vice versa, so that approximately the same current will flow through primary winding 58 at the ignition time regardless of battery voltage.

Figure 4:
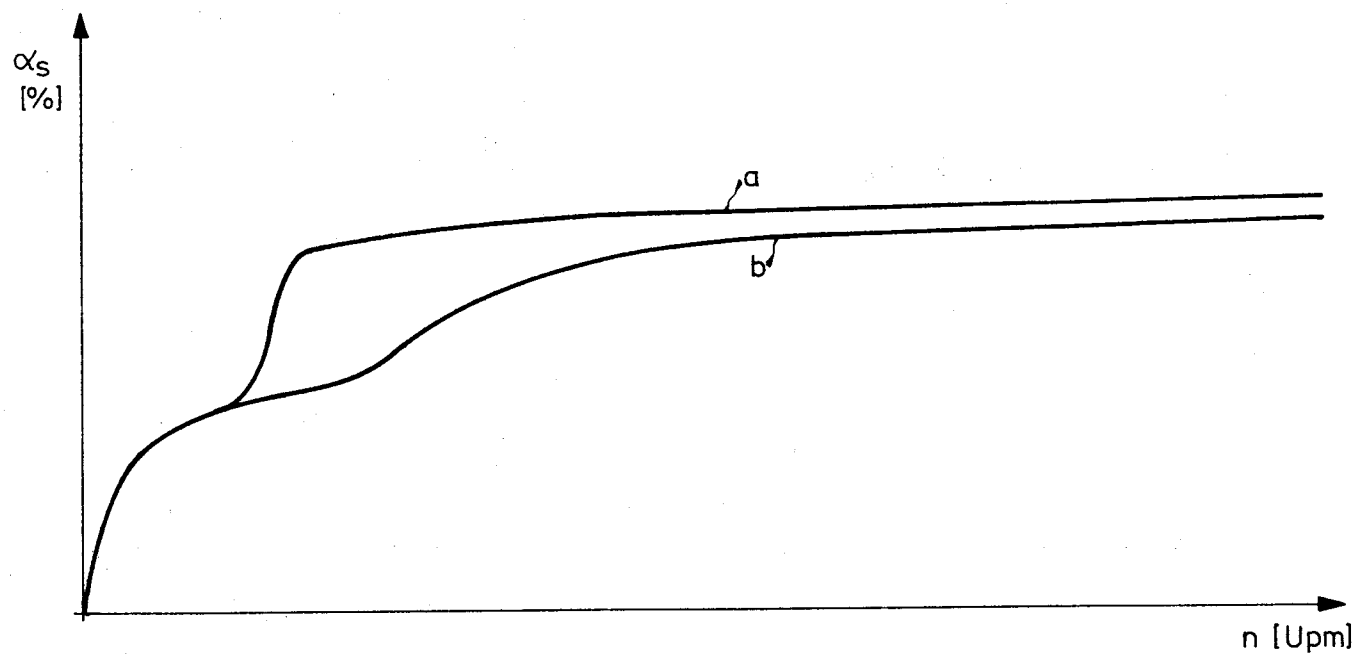
FIG. 4 is a schematic diagram showing the variation of closure angle with respect to speed for the ignition system according to FIG. 1.

The circuit behavior of the circuit of FIG. 1 is summarized in graph a of FIG. 4 which shows the variation of closure angle $\alpha_s$ as a function of speed n. If the inherent thresholds of diodes 78 and 82 are not sufficient for effecting the desired relative closure angle as a function of speed, then Zener diode 88 can be inserted in the charging circuit for capacitor 80 as indicated by the broken lines. Diode 88 causes the increase of closure angle $\alpha_s$ to take place at higher engine speeds, as shown in curve b in FIG. 4.

The very desirable variation of closure angle $\alpha_s$ with respect to speed allows the addition to the circuit of FIG. 1 of a circuit for regulating the current through the primary winding. An ignition system with this addition is shown in FIG. 2.

Figure 2:
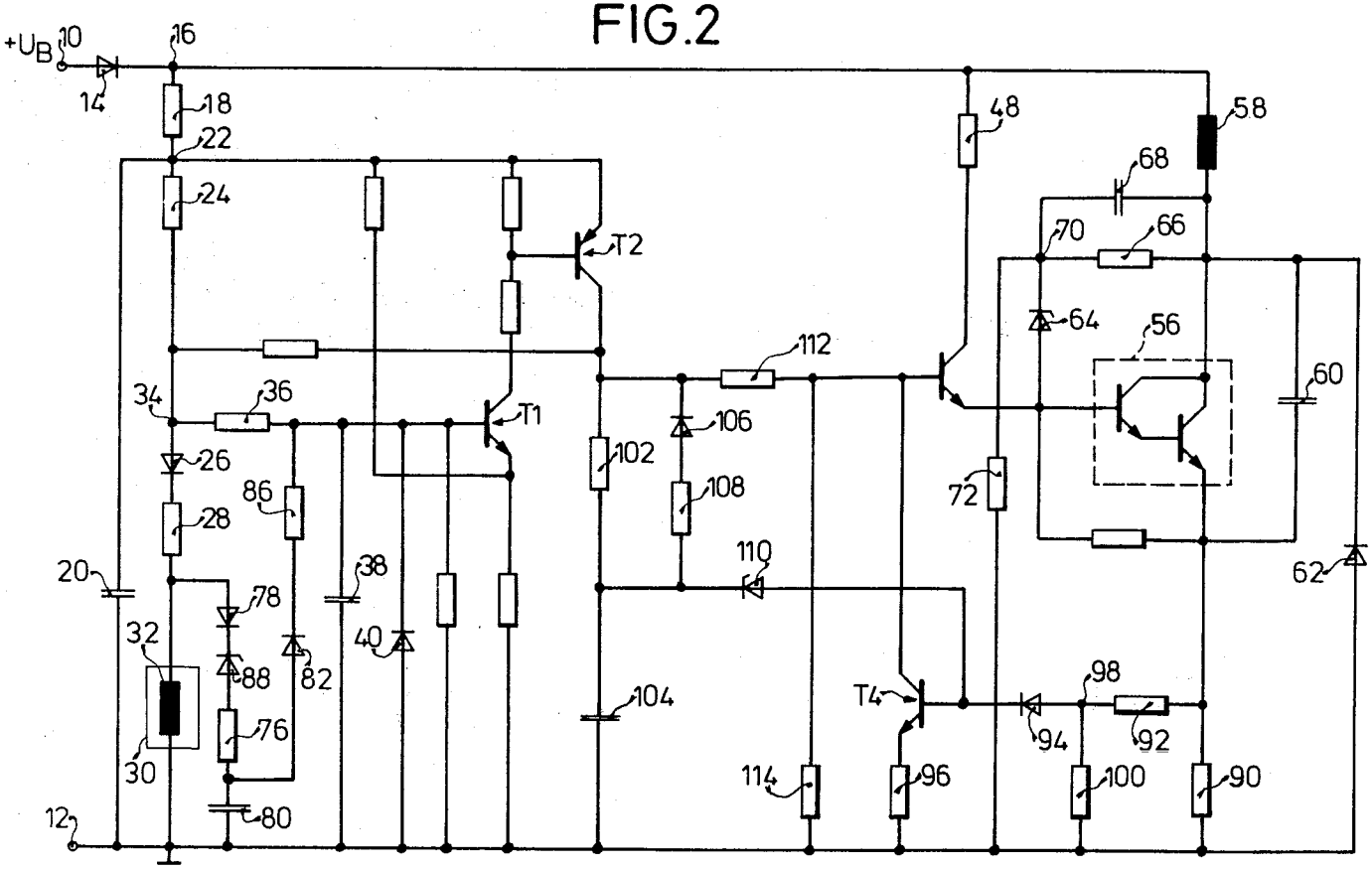
FIG. 2 is a circuit diagram of an ignition system with circuits for regulating the primary current in the ignition coil and for cutting off any quiescent current flowing therein.

The ignition system in FIG. 2 is different from that in FIG. 1 in that a monitoring resistor 90 is connected between the emitter of Darlington transistor circuit 56 and reference potential. Resistor 90 is connected through a resistor 92 and a diode 94 to the base of a transistor T4. The emitter of transistor T4 is connected through a resistor 96 to reference potential, while its collector is connected directly to the base of transistor T3. Further, a resistor 100 is connected between reference potential and the common point 98 of diode 94 and resistor 92.

The operation of the above-described circuit will be discussed below. However, because of the inclusion of this current limiting circuit the ignition system is no longer prevented from carrying quiescent current. Thus additional circuit elements are connected into the circuit of FIG. 2 to prevent quiescent current from flowing. This circuit includes a resistor 102 connected in series with a capacitor 104. The series circuit is connected between the output of a somewhat modified trigger circuit and reference potential. A series circuit including a diode 106 and a resistor 108 is connected in parallel with resistor 102. Further, the quiescent current prevention circuit includes a Zener diode 110 which connects the base of transistor T4 to the common point of resistor 102 and capacitor 104. Further, a resistor 112 is connected between the collector of transistor T2 and the base of transistor T3, while a resistor 114 connects the base of transistor T3 to reference potential. These two resistors decouple the collector of transistor T4 from the output of the trigger circuit.

OPERATION OF THE CIRCUIT OF FIG. 2

The primary current limiting circuit shown in FIG. 2 generally operates in such a way that, when the current through the primary winding reaches a predetermined current, a voltage is generated across monitoring resistor 90 which causes transistor T4 to become conductive and therefore causes transistor T3 to block to the extent that its collector-emitter current no longer suffices to maintain the Darlington circuit 56 in a fully conductive state. The current through the primary winding 58 of the ignition coil is therefore limited so that it cannot rise over a predetermined maximum value.

The quiescent current blocking circuit of FIG. 2 causes capacitor 104 to be charged to almost the full battery voltage $U_B$ during the conduction time, that is while transistor T2 is conductive. When the voltage across capacitor 104 reaches the Zener voltage of Zener diode 110, transistor T4 becomes fully conductive and thereby blocks transistor T3. Diode 94 prevents the flow of base current for transistor T4 to reference potential via the resistance network 90, 92 and 100. The circuit is so designed that Zener diode 110 only operates when transistor T2 remains conductive for a time which exceeds a predetermined tolerance region. If, however, transistor T2 blocks in time (normal operating conditions), then capacitor 104 is discharged through diode 106 and resistor 108 prior to the next closure time.

To summarize, it may be said that an ignition system according to FIG. 2 not only allows a change in closure time over a wide region, but also allows primary current regulation and quiescent current blockage. Specifically, transistor T4 which is required for current regulation is also used to block the Darlington transistor circuit 56 in order to prevent the flow of quiescent current.

Another advantage of the circuit of FIG. 2 relative to that of FIG. 1 is that it can be easily modified so that an additional closure angle control is possible. Particularly, it is desirable that the increase in closure angle be counteracted at least to some extent when the current through the primary winding is close to the maximum current required for proper ignition. This is particularly important for decreasing losses in ignition systems in which the primary circuit is of very low resistance. A so-modified circuit is shown in FIG. 3.

Figure 3:
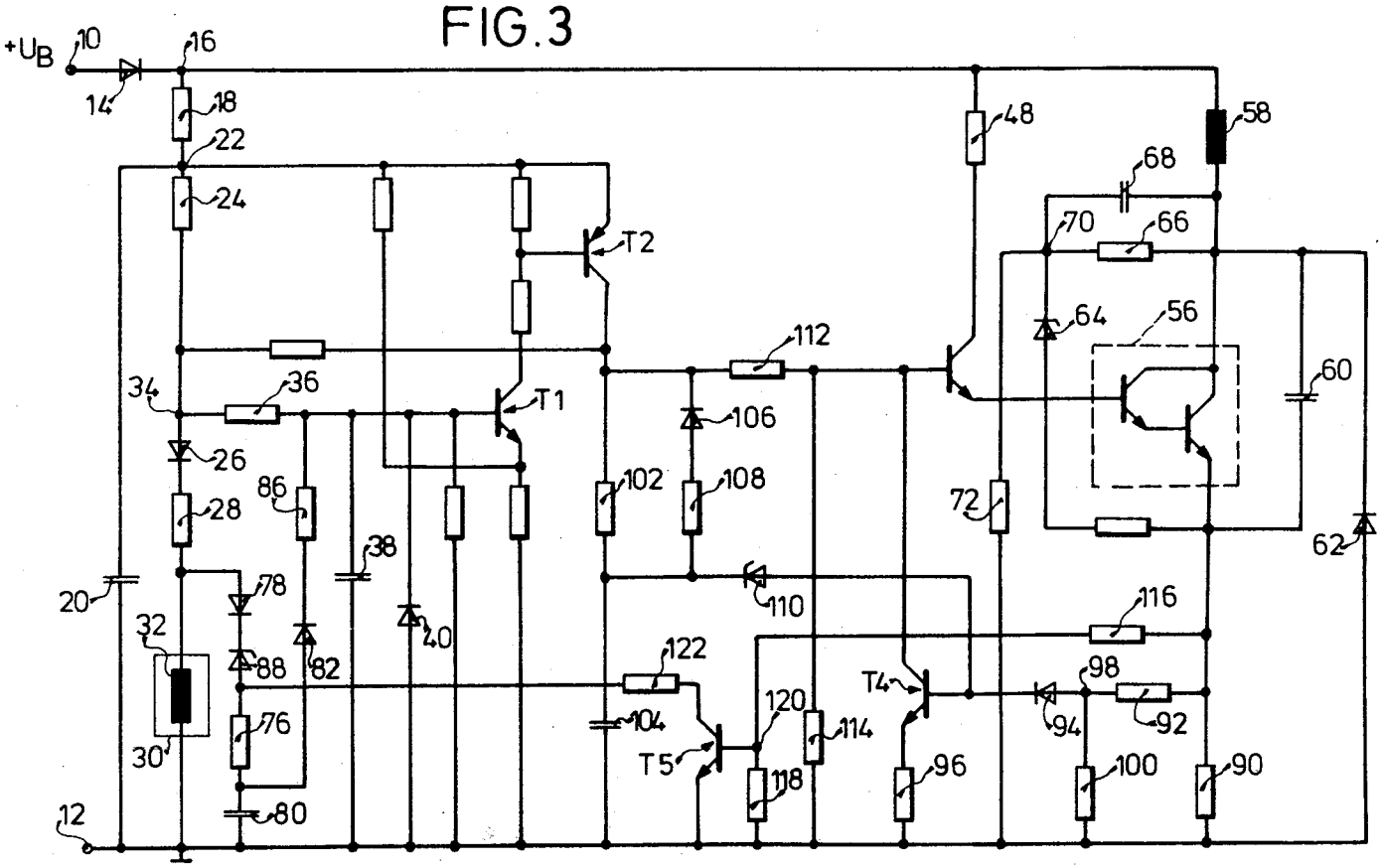
FIG. 3 is a preferred embodiment of the present invention with circuits for primary current regulation, quiescent current shutoff and regulation of the closure angle.

In FIG. 3, the circuit of FIG. 2 is modified by the addition of a series circuit including two resistors 116 and 118 connected in parallel with monitoring resistor 90. The common point 120 of resistors 118 and 119 is connected to the base of a transistor T5 whose emitter is directly connected to the reference potential. The collector of transistor T5 is connected through a resistor 122 to the common point of resistor 76 and diode 88 at the input side of the Schmitt trigger.

OPERATION OF THE CIRCUIT OF FIG. 3

The circuit of FIG. 3 operates to a great extent exactly in the same way as that of FIG. 2, that is the current in the primary winding 58 is limited to a predetermined maximum value and any quiescent current that may flow through the primary winding is cut off. When, in this circuit, a current very close to the maximum predetermined current is reached, the voltage across resistor 90 is sufficient to cause transistor T5 to become conductive. When transistor T5 becomes conductive, current which would normally flow to charge capacitor 80 (i.e. in the circuit of FIG. 2) is shunted by the series combination of resistor 122 and the emitter-collector resistance of transistor T5. Capacitor 80 is thus charged to a lesser voltage at the beginning of the next ignition cycle. This leads to a shortening of the closure time that would otherwise obtain and therefore to a further reduction of preventable losses in the primary circuit.

Figure 5:
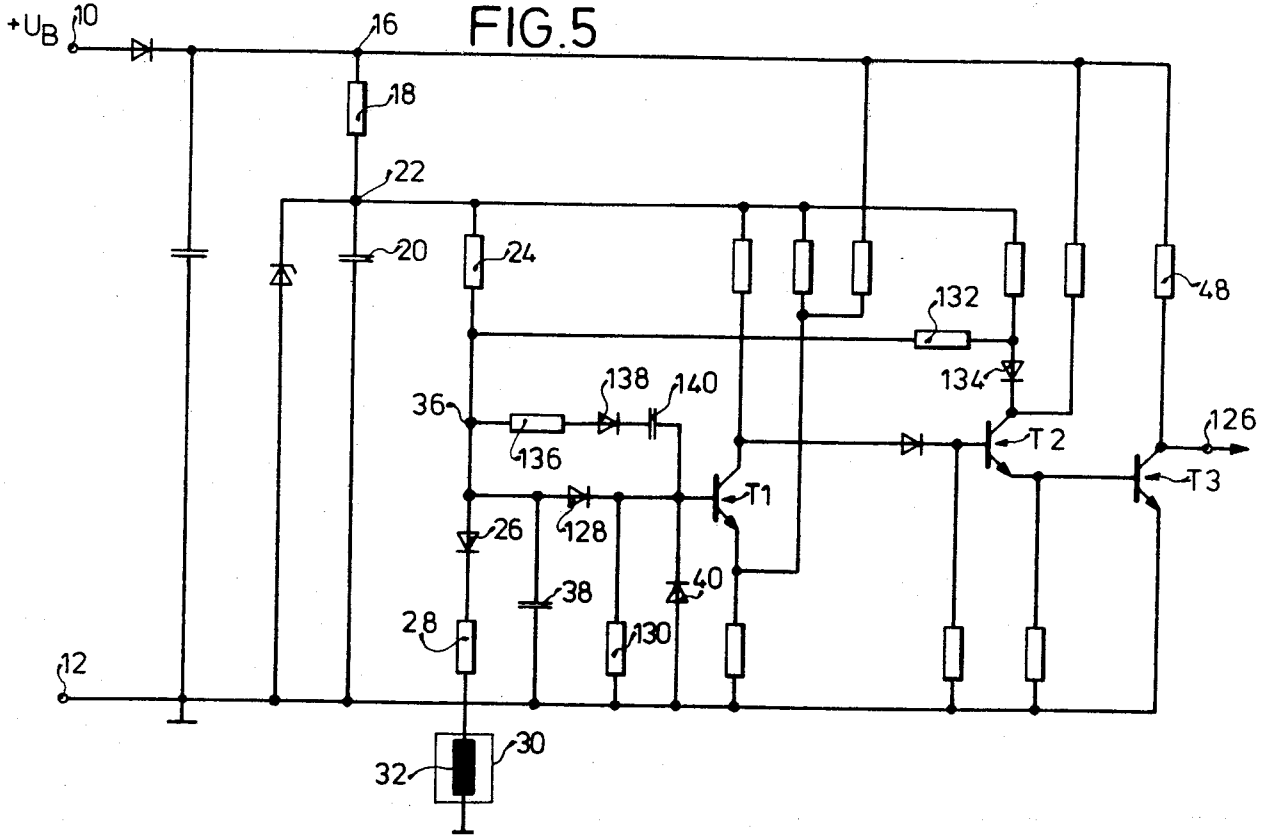
FIG. 5 is a further preferred embodiment of an ignition system according to the present invention.

In the circuit of FIG. 5, transistors T1 and T2 with their associated resistors, etc. form a trigger circuit which is a conventional circuit and need not be explained in detail here. The emitter of transistor T2 constitutes the output of the trigger circuit. It is connected to reference potential through a resistor 124 and is also connected to the base of transistor T3. The emitter of transistor T3 is directly connected to reference potential, while its collector is connected to circuit point 16 through a resistor 48. The output 126 of the circuit of FIG. 5 is at the collector of transistor T3. This output drives an output stage (not shown) which is similar to the output stage in the arrangement shown in FIGS. 1–3.

In the circuit of FIG. 5, the series circuit including resistors 18 and 24, diode 26 and resistor 28 connected between circuit point 16 and one end of output winding 32 of signal generator 30 is again provided. However, the common point 36 of resistors 24 and diode 26 is connected to the base of transistor T1 through a diode 128. The cathode of diode 128 is connected through a resistor 130 to reference potential. A diode 40 is connected in parallel with resistor 130. Capacitor 38 is directly connected between circuit point 36 and reference potential. Circuit point 36 is also connected through a resistor 132 and a diode 134 to the collector of transistor T2. Resistor 132 forms a positive feedback resistor for the trigger circuit. Finally, a series circuit including a resistor 136, a diode 138 and a capacitor 140 is connected between circuit point 36 and the base of transistor T1.

OPERATION OF THE CIRCUIT OF FIG. 5

When the voltage across output winding 32 is positive relative to reference potential, diode 26 blocks which causes transistor T1 to become conductive. This in turn causes transistor T2 which was conductive up to this time to be blocked in turn blocking driver transistor T3. The output stage controlled by the signal at terminal 126 is such that the electronic interrupter switch will close when transistor T3 is blocked. A current therefore starts to flow through the primary winding.

When the voltage across winding 32 then becomes negative and, particularly, more negative than the switch-out threshold of the trigger circuit, then transistor T1 blocks, so that transistors T2 and T3 become conductive thereby opening the interrupter switch in the output stage and initiating a spark.

When the voltage across output winding 32 of signal generator 30 becomes sufficiently negative that the voltage at circuit point 36 is more negative than that at the base of transistor T1 by an amount equalling the Zener voltage of Zener diode 138, then capacitor 140 charges through diode 40 through a charging circuit including Zener diode 138, resistor 136, diode 26 and resistor 28. When, following the charging of capacitor 140, circuit point 36 again reaches a less negative potential, then the potential at the base of transistor T1 is correspondingly more positive by the value of the voltage across capacitor 140, so that transistor T1 becomes conductive earlier during the increase towards positive values of the output voltage of winding 32. At this earlier time, when transistor T1 becomes conductive, it discharges capacitor 140. The capacity of capacitor 140 must therefore be sufficient that it can maintain transistor T1 in the conductive state until such time as the voltage across winding 32 reaches a sufficiently positive value so that the normal switch-in potential of transistor T1 is reached. In the circuit of FIG. 5, the Zener voltage of diode 138 will, for a predetermined output voltage across winding 32 determine the speed at which the closure angle is increased in accordance with the present invention relative to the normally present on/off ratio of the interrupter switch. The transitional circuit action and the maximum possible closure angle is determined by the value of resistor 136.

The foregoing description of the circuit of FIG. 5 shows clearly that this circuit operates substantially in the same way as the circuit of FIG. 1. It is also possible to omit the Zener diode if it is desired to increase the closure angle relative to the controlled on/off state of the interrupter switch at relatively low engine speeds. It should also be noted that in the circuit of FIG. 5 as well as in the circuits of FIG. 2 and FIG. 3 a number of resistors which in a perfectly conventional way serve to create necessary bias voltages, etc. are not given reference numbers and are not explained in detail. In FIG. 2, the resistor connected in parallel to the base-emitter circuit of transistor 56 serves to discharge charge carriers when the transistor blocks.

Various changes and modifications may be made within the scope of the inventive concepts:

We claim:

1. In an ignition system in an internal combustion engine having means (30) for generating a speed-dependent signal having an amplitude varying as a predetermined function of engine speed, an ignition coil having a primary winding (58), interrupter switch means (56) connected in series with said primary winding, and trigger circuit means connected to said speed-dependent signal generating means and said interrupter switch means and having a predetermined switch-in and switch out threshold for switching said interrupter switch means alternately into the conductive and blocked state, apparatus for increasing the ratio of conductive to blocked time of said interrupter switch means with increasing engine speed, comprising storage means (80, 140);

circuit means (78, 40) including at least one unidirectional conducting element for connecting said storage means to said speed-dependent signal generating means and said trigger circuit means so that storage means is charged in accordance with said speed-dependent signal while said trigger circuit means is in a switched-out state and so that the so-created charge on said storage means shifts said thresholds of said trigger circuit means in a direction increasing the time said interrupter switch means is in said conductive state;

and means (88, 138) interconnected between said storage means and said speed-dependent signal generating means for delaying said charging of said storage means until said speed of said engine has reached a predetermined minimum speed.

2. A system as set forth in claim 1, wherein said storage means comprises a capacitor.

3. A system as set forth in claim 2, wherein said unidirectional conducting element is a diode.

4. A system as set forth in claim 1, wherein said delay means comprises a Zener diode.

5. A system as set forth in claim 1, wherein said speed-dependent signal generating means comprises an output winding having a first terminal connected to reference potential and a second terminal;

further comprising a battery for supplying energy to said ignition system, said battery having a first terminal connected to said first terminal of said output winding, voltage divider means (24, 26, 28) having a first end terminal connected to said output winding, a second end terminal and a voltage divider tap, and a resistor (36) connected between said voltage divider tap and an input of said trigger circuit means for generating a bias voltage for said trigger circuit means.

6. A system as set forth in claim 1, further comprising means (90–100, T4) connected to said interrupter switch means for limiting the current therethrough to a predetermined maximum current.

7. A system as set forth in claim 1, further comprising means (90) for monitoring the current through said primary winding and furnishing a limit signal when said current reaches a predetermined value; and means (116–122, T5) for decreasing said charging of said storage means thereby decreasing the time said interrupter switch means is in said conductive state in response to said limit signal.

* * * * *